US006932147B2

(12) United States Patent
Evertz et al.

(10) Patent No.: US 6,932,147 B2
(45) Date of Patent: Aug. 23, 2005

(54) CONTINUOUS CASTING INGOT MOULD

(75) Inventors: Egon Evertz, Solingen (DE); Rolf Seybold, Solingen (DE)

(73) Assignee: Egon Evertz K.G. (GmbH & Co.), Solingen (DE)

( * ) Notice: Subject to any disclaimer, the term of this patent is extended or adjusted under 35 U.S.C. 154(b) by 0 days.

(21) Appl. No.: 10/466,754

(22) PCT Filed: Feb. 7, 2002

(86) PCT No.: PCT/DE02/00443

§ 371 (c)(1),
(2), (4) Date: Jul. 18, 2003

(87) PCT Pub. No.: WO02/064286

PCT Pub. Date: Aug. 22, 2002

(65) Prior Publication Data

US 2004/0050529 A1 Mar. 18, 2004

(30) Foreign Application Priority Data

Feb. 9, 2001 (DE) ..... 101 06 328
May 4, 2001 (DE) ..... 101 21 753

(51) Int. Cl.[7] ..... B22D 11/00
(52) U.S. Cl. ..... 164/418; 164/435
(58) Field of Search ..... 164/418, 435, 164/436

(56) References Cited

U.S. PATENT DOCUMENTS 4,207,941 A * 6/1980 Shrum ..... 164/484
4,249,590 A 2/1981 Willim
4,716,955 A 1/1988 Fstert
4,811,779 A * 3/1989 Streubel et al. ..... 164/418
5,279,354 A * 1/1994 Grove ..... 164/491
5,360,053 A * 11/1994 Kawa et al. ..... 164/418
5,460,220 A * 10/1995 Coassin ..... 164/483
5,592,988 A * 1/1997 Meroni et al. ..... 164/478

FOREIGN PATENT DOCUMENTS

| | | |
|---|---|---|
| DE | 887 990 | 8/1953 |
| DE | 36 40 525 | 6/1988 |
| DE | 39 07 351 | 9/1990 |
| DE | 41 31 829 | 4/1992 |
| DE | 43 43 124 | 6/1995 |
| DE | 197 42 795 | 4/1999 |
| DE | 201 02 524 | 8/2001 |
| EP | 0 300 219 | 8/1991 |
| EP | 0539 829 | 5/1993 |
| EP | 0552 501 | 7/1993 |
| EP | 0 904 873 | 3/1999 |

* cited by examiner

*Primary Examiner*—Jonathan Johnson
*Assistant Examiner*—Len Tran
(74) *Attorney, Agent, or Firm*—Herbert Dubno

(57) ABSTRACT

An ingot mold for continuous casting of metal strips or thin slabs has a funnel-shaped, charged are which is tapered to the format of the cast strand, and two ingot mold plates which are deformed in relation to each other and which have curved pouch-type broad side wall sections. The curvature of the curved pouch-type broad side wall sections is elliptical in the cross-section thereof.

12 Claims, 5 Drawing Sheets

CONTINUOUS CASTING INGOT MOULD

CROSS REFERENCE TO RELATED APPLICATIONS

This application is a national stage of PCT/DE02/00443 filed 7 Feb. 2002 and is based upon German national applications 101 06 328.8 of 9 Feb. 2001 and 101 21 753.6 of 4 May 2001 under the International Convention.

FIELD OF THE INVENTION

The invention relates to a continuous casting mold for the continuous casting of metal strip or thin slabs with a charging region which tapers in a funnel shape in the casting direction to the thickness or format of the cast strand, with two mold plates clamped together and with curved pouch-shaped broadside wall sections.

FIELD OF THE INVENTION

Already in German Patent 887990 water cooled continuous molds have been described with which small slabs, for example with dimensions of 450 mm×20 mm, can be produced. The water cooled molds for continuous casting have a width which is much greater than the thickness and whose lower part is comprised of mutually juxtaposed parallel walls and end walls, whereby the width of the side walls of the elongated rectangular vertically disposed mold chamber is much greater than that of the end walls. The end walls of the further mold part extend linearly into the upper mold part while the side walls of the upper mold part widen upwardly in a funnel shape. The upper part of the mold should be rhombus shaped in cross section.

In DE 36 40 525 C2 a continuous casting mold has been described in which the broad side walls in the charging regions are comprised each of first sections which are parallel to one another and each of which is then connected to a section which converges to the thickness of the casting format, whereby the first section extends to below the level of the casting melt which is maintained in the casting region. The opening, which widens in a funnel shape and is provided in the casting region, is configured with a trapezoidal cross section.

A charging region which is also of trapezoidal shape correspondingly is shown in EP 0 3 002 19 B1.

In DE 43 43 124 A1, a mold for continuous casting of the steel strip and having broadside walls is proposed which in the funnel shaped casting region has convex circular arc segments and laterally thereof in the funnel shaped casting region running outwardly to the small sides, inclined surfaces which approach one another.

Other mold plate shapes comprise pouch-shaped curved broad side regions in the charging region, whose curvatures correspond to lateral circular arcs and at tangent points or inversion points connect to central circular arcs whose radii are successively greater with increasing distance from the upper edges of the mold. In EP 0 552 501, such an embodiment has been proposed in which the radii of the lateral structure arcs have radii which remain the same over a distance downwardly from the upper edges of the mold through at least 100 mm and preferably over the entire height of the charging region.

In all of the described continuous casting molds, the problem arises that the advancing strand which is partially solidified along its exterior can jam in the mold and with a tearing of the outer already solidified mold shell can give rise to a breakout of the liquid casting material from the mold interior. Nonuniformly shaped previously hardened continuous shells and an impending partial breakthrough can give rise to undesired depressions or cracks in the end product. In addition, the partially solidified shell is loaded in compression in the region of the pouches of the mold in a direction perpendicular to the casting direction since the spread in this direction over the length of the pouch is reduced. This gives rise to a forced deformation of the shell.

In addition, it has been found that pouch like charging regions which have convex inner regions and concave curvature in their outer regions, have the problem that the outer partially solidified strand, because of the compressive stresses in the curvatures at the edges, during advance of the strand, can be subjected to nonuniform cooling as a consequence of which there is an increased danger of jamming of the advancing strand in the mold.

OBJECT OF THE INVENTION

It is the object of the invention to improve upon a continuous casting mold as described at the outset such that the aforementioned drawbacks are overcome or at least significantly minimized.

SUMMARY OF THE INVENTION

This object is attained with an improved continuous casting mold.

According to the invention, the mold plates which are clamped together have curved pouch-shaped broad side wall sections casting region which have substantially elliptical curvature in cross section. Surprisingly it has been found that such casting pouches or pockets have the effect that already hardened portions of the continuous casting shell at the outer periphery, upon advance of the strand in the mold, are pressed largely uniformly at all locations against the inner wall of the mold, whereby the transverse deformation of the shell is favored and clamping in the mold is uniformly hindered while a homogeneous solidification is effected. The term "elliptical curvature" means such curvature that is generated by the intersection of an inclined cylinder with a plane whereby each of the mirror symmetrically opposite pouches of the mold plates is comprised of a partial elliptically shaped cross section. Preferably the pocket-shaped curved broad side wall sections of both mold plates are so shaped that they have identical space curves corresponding to the intersection of an inclined cylinder with a plain parallel plate. The means that transversely to the casting direction a convex casting region corresponding to the aforedescribed section is obtained which tapers in the casting direction to the thin slab width dimension. An advantage of such a configuration is that the pouch shaped curved portions, by contrast with the solutions proposed by the state of the art, are of shorter configuration in the casting region and thus the length over which the slab is guided in the mold with its final cross section is greater.

The contour between the plane and the pocket or pouch can be provided with a radius between 5 mm and 100 mm, preferably 20 mm.

To increase the volumetric throughput or the heat outflow in the charging region, according to a further refinement of the invention, the curved broad side segment of each mold plate extends to 2 cm to 5 cm from the edge region (of the small side). The depth at the center of the pouch and thus the maximum depth (of the curved broadside section) amounts to 40% to 60%, preferably 50% to 60%, of the mold plate height.

According to a further feature of the invention, the mold outside the pouch is configured to be conical or tapered in the casting direction. The measure of the conicity used preferably lies between 0.9% to 1.3% per 1 meter, especially 1% per 1 meter.

The metal melt which is supplied by the immersion nozzle extending into the charging region from the tundish moves in the embodiments known from the state of the art in the continuous casting mold not in the form of a linear homogeneous flow. Rather there develops in the upper region of the mold turbulence which can increase the incorporation of dirt particles into the melt or enable various impurities to b entrained therewith and which as a result of the nonlinear molten bath movements can be incorporated.

So as to minimize to the greatest extent possible such dirt inclusions or to so direct the molten bath movements that possible inclusions are found primarily at the strand surfaces, where they can be easily removed by grinding or by machining, the pouch shaped broadside wall sections have a nonlinear profile in longitudinal section.

Turbulence arises whenever large gradients of the flow velocity are provided transverse to the flow direction. The resistance in turbulent flow is substantially greater than that in laminar flow, as a consequence of which, vortex formation and the danger of mixing dirt particles into the liquid and forming the resulting inclusions, which is associated with that vortex formation, can occur. With the features of the invention, the longitudinal profile of the broad side wall sections is no longer of linear configuration over the height of the casting region but surprisingly can counteract a strong turbulence in the metal melt. Depending upon the flow velocity and the flow resistance which is given by the mold geometry, the molten bath composition and the molten bath temperature, horizontal movements of the melt can be significantly minimized so that an improved flow of the melt can be observed. For the configuration of the longitudinal section profile, a number of possibilities are then opened up as described below.

The longitudinal sectional profile can be concave or convex with a radius of curvature which is constant or changing over the height of the broadside wall sections. Furthermore, also other such profile configurations are effective in which convex and concave profile sections are connected one after the other in the flow direction, whereby for example, a somewhat sine-curve shaped pattern of the longitudinal profile line in question can be provided. In a further embodiment of the invention, the longitudinal section profile can be assembled from a multiplicity of partial pieces with respective different radii of curvature, whereby over the total height, either a strictly convex or concave pattern or those to which convex and concave segments are connected can be used.

In the sense of the present invention, also included are such broad side wall section horizontal section profiles assembled from respective adjoining linear partial segments, each of which is at an obtuse angle to another and which as a whole give rise to a concave or a convex profile contour. If desired, to avoid gullies or crevices which can promote turbulent flow, the transition regions from one linear section to the other can be rounded. Included in the sense of the invention are also such longitudinal section profiles in which concave and/or convex partial regions and other partial regions which are linear, are formed.

A substantially elliptical curvature in cross section of the broad side walls has the effect that on its outer periphery, the already solidified shell of the continuous casting is pressed largely uniformly against the inner wall of the mold at each location as it advances through the mold which provides for a satisfactory transverse deformation of the shell and uniformly prevents clamping and thus gives rise to a homogeneous solidification.

Preferably the broad side wall sections which are formed by the curved pouch shapes are provided on both mold plates so that their space curves are equal in size and correspond to an intersection of an inclined cylinder with a plane parallel plate. This means that transversely to the casting direction a convex casting region or charging region is formed as given by the described intersection, which tapers in the casting direction to the dimensions of the thin slab. An advantage of this configuration is that the pouch shaped curves can be shorter than the proposed solutions of the prior art in the casting direction and that, as a result, the length over which the slab is guided in the mold with its final cross section can be greater.

The contour between the plane and the pouch can be provided with a radius between 5 mm and 100 mm, preferably 20 mm.

To increase the throughput volume or the outgoing heat flow in the charging region, according to a further refinement of the invention it is provided that the curved broad side sections extend up to 2 cm to 5 cm from the edge region (at the small side) of each mold plate. The mean depth (and thus the maximum depth) of the pouch (of the curved broad side section) amounts to 40% to 60%, preferably 50% to 60% of the mold plate height.

BRIEF DESCRIPTION OF THE DRAWING

Examples of the present invention are shown in the drawing. In the drawing.

SPECIFIC DESCRIPTION

Figure 2:
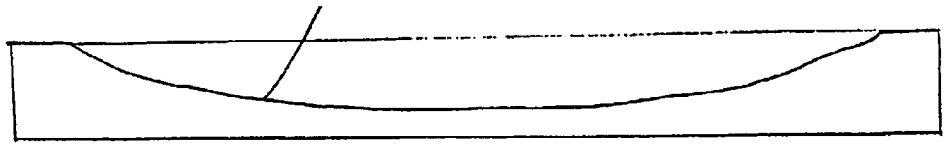
FIG. 2 is a plan view of this continuous casting mold.
Figure 3:
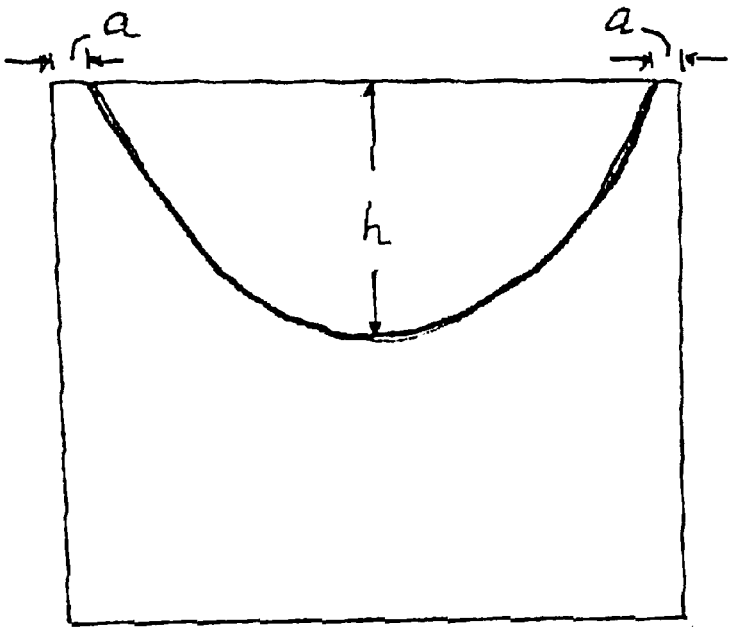
FIG. 3 is a longitudinal section in the region of the junction between a mold plate and the small side walls.
Figure 3A:
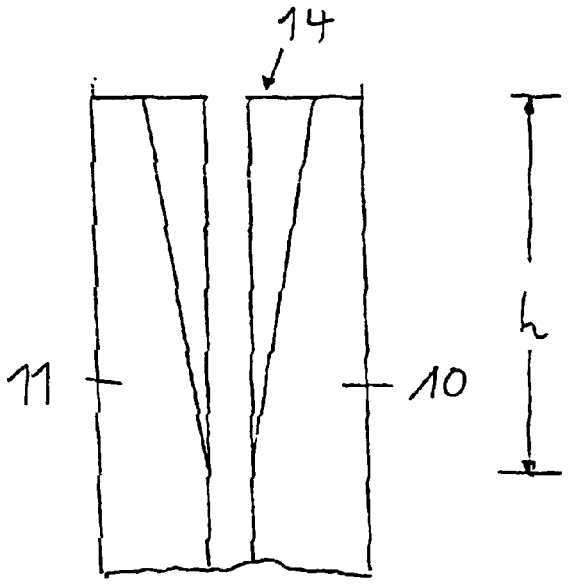
FIG. 3*a* is a section along the line I—I through the upper mold section.
Figure 3B:
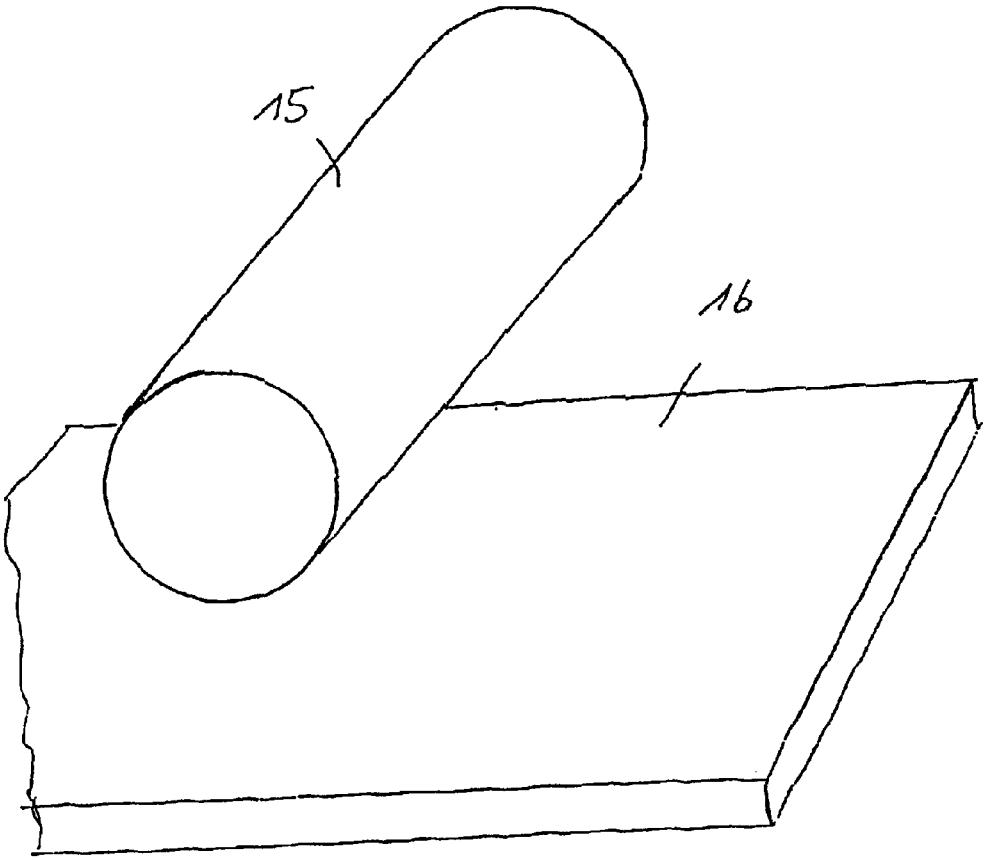
FIG. 3*b* is a diagrammatic illustration of the intersection of a cylinder with a plane parallel plate.
Figure 4:
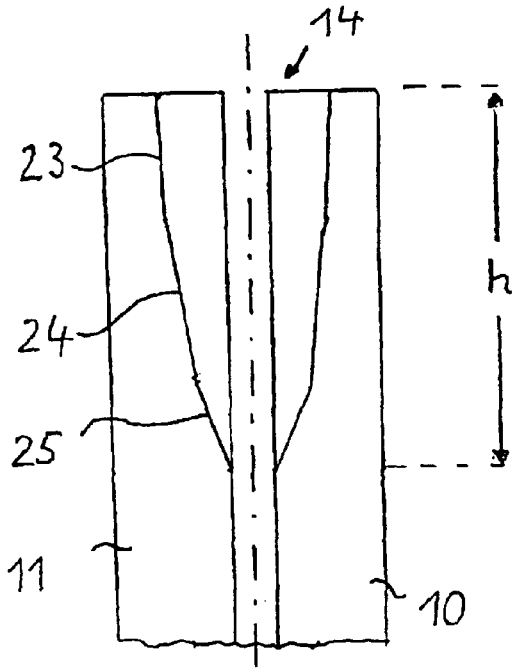
FIG. 4 is a longitudinal section along the line I—I in FIG. 1 with a further refinement.

The continuous casting mold is comprised basically of two mold plates 10 and 11 clamped together and which form the broad side walls with their inner surfaces. In the charging region, the broad side walls are curved in a pouch-like manner so that there an immersion tube or tundish nozzle, not shown, can be introduced. The small side walls 12 and 13 have a significantly smaller width than the broad side walls. The charging opening indicated at 14 in FIG. 1 has the elliptical curvature visible from FIG. 2 and which extends by a dimension of 2 cm to 5 cm from the edge region of the broad side. Such a partially elliptical curvature results from a section through a cylindrical shape 15 with a plane 16 (compare FIG. 5) whereby the height h visible in a plan view in FIG. 3 of the mold plate pocket is a maximum of 50% to 60% of the total mold plate height. As can be deduced from FIGS. 1–3, the respective curved recesses on the inner sides of the mold plates are mirror symmetrical to one another, also in their special configuration. In the lower regions, the mold plate inner sides are planar and configured to be arranged parallel to one another.

Figure 1:
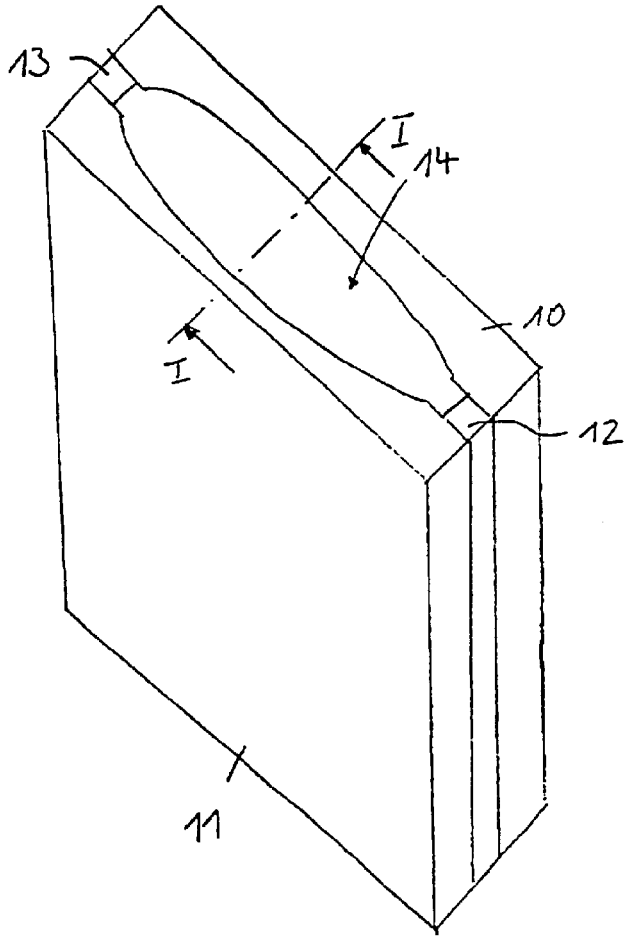
FIG. 1 a schematic perspective view of a cast mold having two continuous casting mold plates clamped together.
Figure 5:
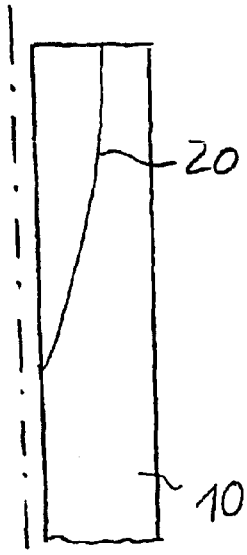
FIGS. 5 to 10 are respective corresponding longitudinal sections of a mold plate.
Figure 6:
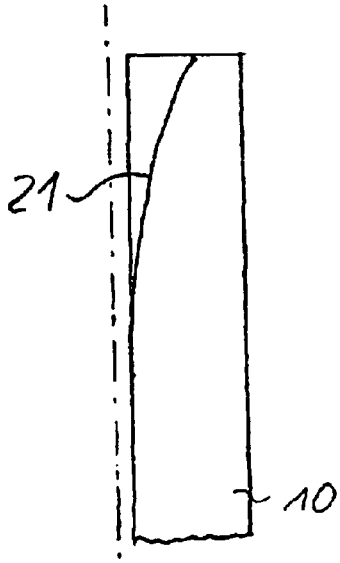
Figure 10:
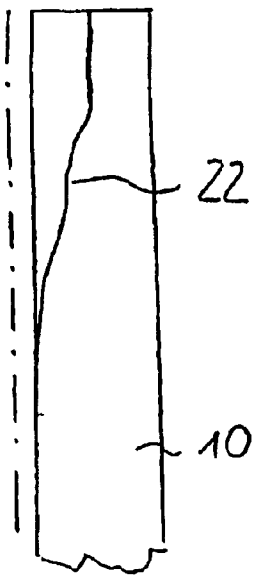

A further refinement according to the invention of the pouch-shaped broad side wall section can be deduced from FIGS. 4–10 where it is seen in longitudinal section. The longitudinal profile is not continuously linear. As is shown in FIGS. 5 and 6, a concave profile 20 or a convex profile 21 with a unitary curvature direction extending the entire height h can be chosen. The radius of curvature can either be constant, as has been shown in FIGS. 5 and 6 can vary in the casting direction. It is also possible to select the longitudinal profile illustrated in FIG. 10 which is assembled from a succession of convex and concave regions of different curvatures. In the embodiment examples according to FIGS. 4 and 7–9, the convex and/or concave configurations are realized by linear profile segments which adjoin one another. In FIG. 1, for this purpose 3 linear sections 23, 24 and 25 are arranged in succession to a longitudinal profile whereby the respectively adjoining linear sections form obtuse angles with one another. In total they provide a convex pattern which is a technically equivalent solution to the profile pattern 20 of FIG. 5.

Figure 7:
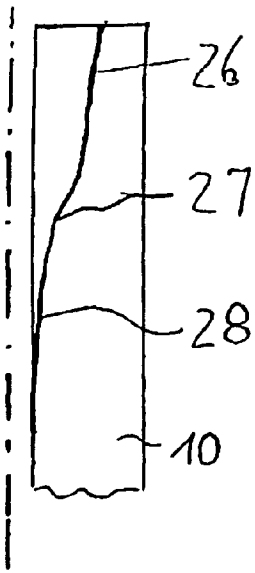

According to FIG. 7 the profile pattern which is provided has a concave region 26 connected to a convex region 28. The transition region forms an inflection point from a concave to a convex curvature. As can be seen from this figure the radius of curvature in the upper and lower regions is significantly greater than or relative to the radius of curvature of the intermediate region.

Figure 8:
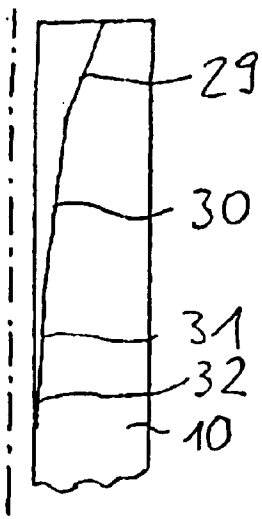

FIG. 8 shows a substantially convex pattern which is realized by 4 linear profile regions 29–32 adjoining one another.

Figure 9:
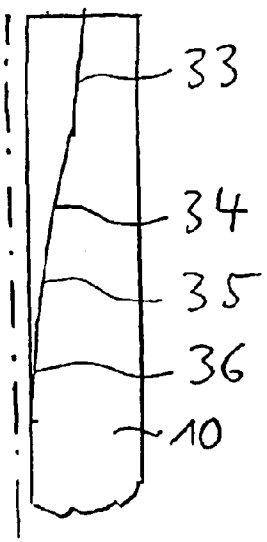

FIG. 9 shows generally a profile pattern corresponding to the profile of FIG. 7 in which the respective linear pieces 33–36 can be distinguished and which adjoin one another at angles which differ from 180°.

What is claimed is:

1. A continuous casting mold for the continuous casting of metal strip or thin slab with a charging region tapering with a funnel shape in the casting direction to the dimensions of the cast strand, with two mold plates clamped together and with broad side wall sections of curved pouch shape, wherein the curved pouch-shaped broad side sections have a substantially elliptical curvature in cross section, the curved broad side wall sections extending up to a distance (a) of 2 cm to 3 cm from the edge region of each mold plate.

2. The continuous casting mold according to claim 1 wherein the maximum depth (h) at the center of the curved broad side sections amounts to 40% to 60% of the mold plate height.

3. The continuous casting mold according to claim 1 wherein the mold is configured to be conical in the casting direction and has a conicity of 0.9% to 1.3% per 1 meter.

4. The continuous casting mold defined in claim 1 wherein is curved broad side wall sections of both mold plates have a curvature corresponding to the in section of a cylinder with a plane.

5. The continuous casting mold defined in claim 1 wherein the maximum depth (h) at the center of the curved broad side wall sections is 50% to 60% of the mold plate height.

6. The continuous casting mold according to claim 1 wherein the mold is conical in the casting direction with a conicity of 1% per meter.

7. The continuous casting mold according to claim 1 having a partition between the curved broad side wall sections and mold plate surfaces around them rounded with a radius of curvature between 5 mm and 100 mm.

8. The continuous casting mold according to claim 1 wherein the pouch shaped broad side wall sections have a nonlinear profile in longitudinal section.

9. The continuous casting mold according to claim 8 wherein the longitudinal section profile is of convex and/or concave curvature.

10. The continuous casting mold according to claim 8 wherein the longitudinal section profile is assembled from a plurality of partial segments with different radii of curvature and a curvature in the upper mold region is concave and a region therebelow is convex.

11. The continuous casting mold according to claim 8 wherein the convex curvature and/or concave curvature is formed by linear segments adjoining one another at obtuse angles.

12. The continuous casting mold according to claim 8 wherein said pouch shaped broad side wall sections have in longitudinal section an elliptical curvature.

* * * * *